United States Patent [19]

Searer et al.

[11] Patent Number: 4,947,937

[45] Date of Patent: Aug. 14, 1990

[54] SPRING-OPERATED TAMBOUR APPARATUS

[75] Inventors: Floyd A. Searer; Ralph Searer, both of Elkhart, Ind.

[73] Assignee: FAS Industries, Inc., Elkhart, Ind.

[21] Appl. No.: 328,384

[22] Filed: Mar. 24, 1989

[51] Int. Cl.[5] ..... E06B 9/08

[52] U.S. Cl. ..... 160/133; 160/26; 160/33; 160/313

[58] Field of Search ..... 160/133, 313, 201, 66, 160/32, 33, 26, 23.1, 188

[56] References Cited

U.S. PATENT DOCUMENTS

| | | | |
|---|---|---|---|
| 1,295,712 | 2/1919 | Drew | 160/313 X |
| 3,357,480 | 12/1967 | Matsumoto | 160/133 |
| 3,516,469 | 6/1970 | McDonald | 160/133 X |
| 4,565,231 | 1/1986 | Moessner et al. | 160/133 |

FOREIGN PATENT DOCUMENTS

| | | | |
|---|---|---|---|
| 1293019 | 4/1962 | France | 160/133 |
| 1465993 | 12/1966 | France | 160/133 |

*Primary Examiner*—Blair M. Johnson

*Attorney, Agent, or Firm*—Watson Cole Grindle & Watson

[57] ABSTRACT

In a tambour door opening/closing apparatus, a tambour door is moved along a longitudinal axis between open and closed positions under restraint of a frame guiding opposed sides of the door. A constant spring is mounted to the tambour door and has a section thereof extending generally along the longitudinal axis to assist in moving the tambour door between the opened and closed positions. A fixed rod is mounted between the frames guiding both sides of the door and a spool is rotatably mounted on the rod with the spring being coiled around the spool and the exposed end of the constant spring is attached to the tambour door. A track assembly is mounted on each side of the frame for guiding the movement of the tambour door and includes a substantially straight portion extending substantially the length of the opening and a loop portion with a coiled track for forming coils of the tambour door. A fixed spacer rod is mounted between each track assembly adjacent the tambour door between the tambour door and the coiled track with the fixed rod and the fixed spacer rod lying substantially in the same plane.

6 Claims, 3 Drawing Sheets

FIG. 5
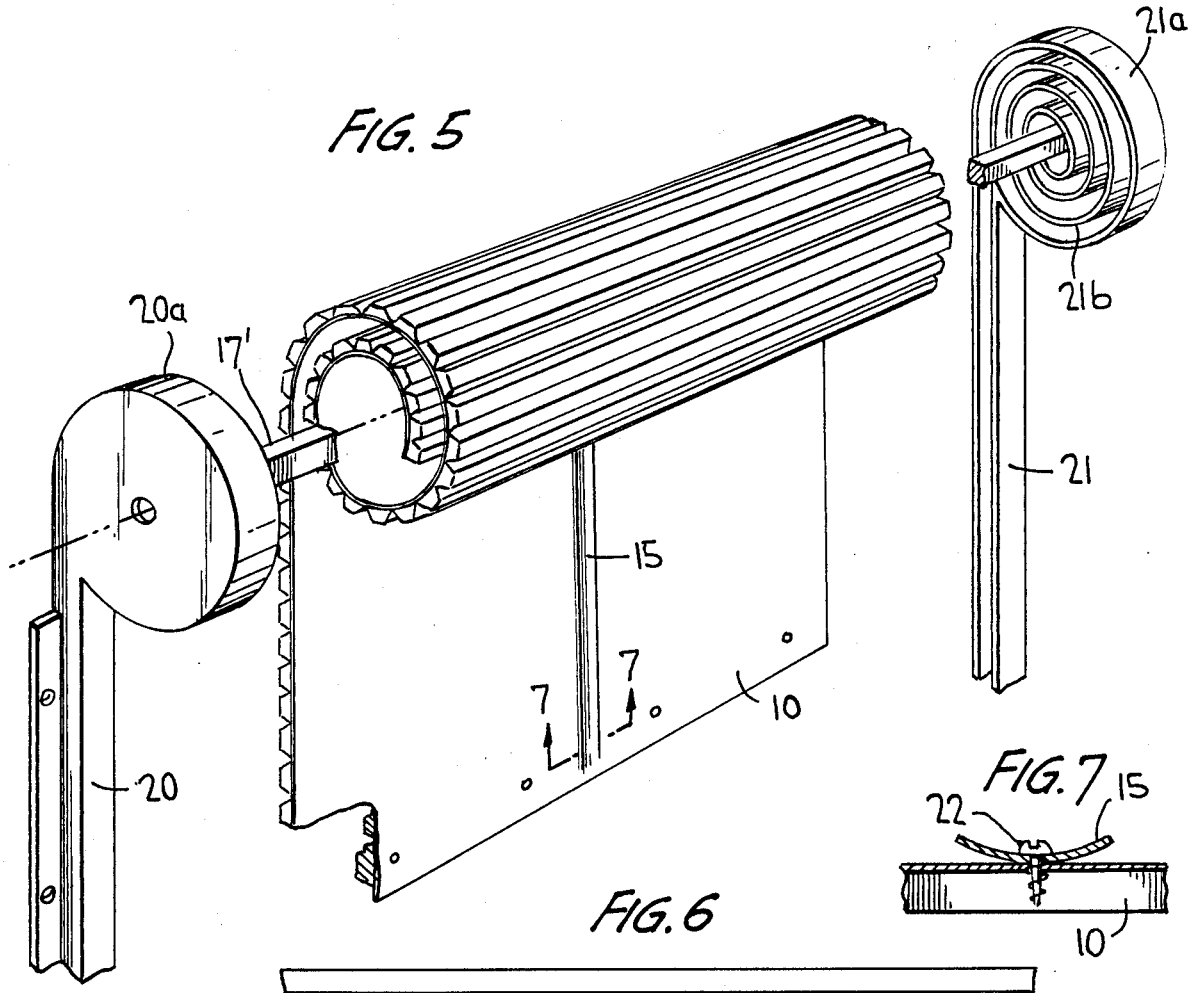
FIG. 7
FIG. 6
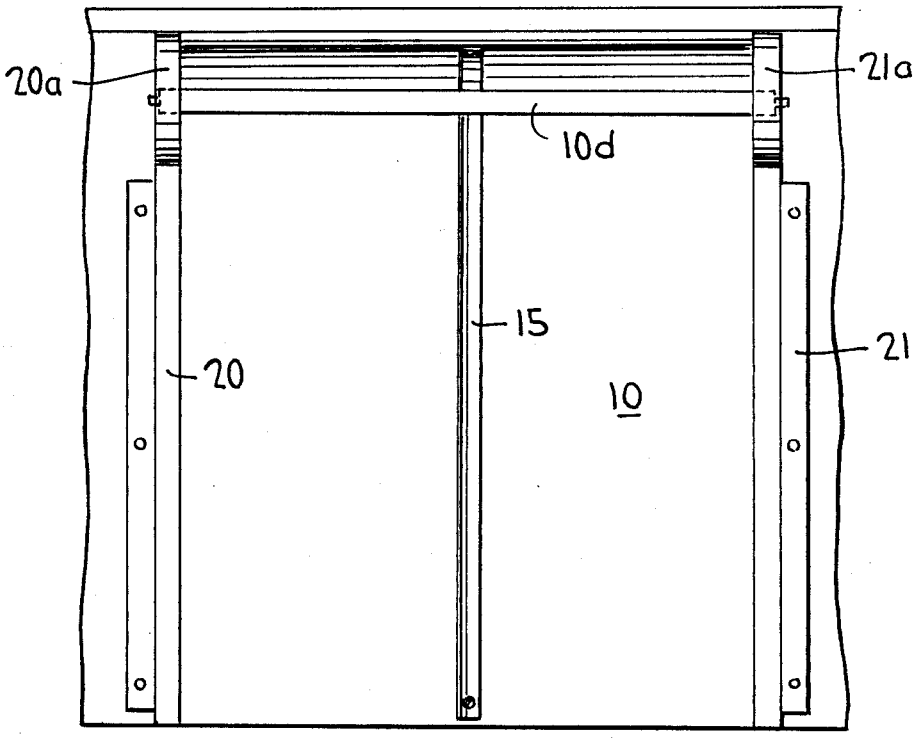

FIG. 8
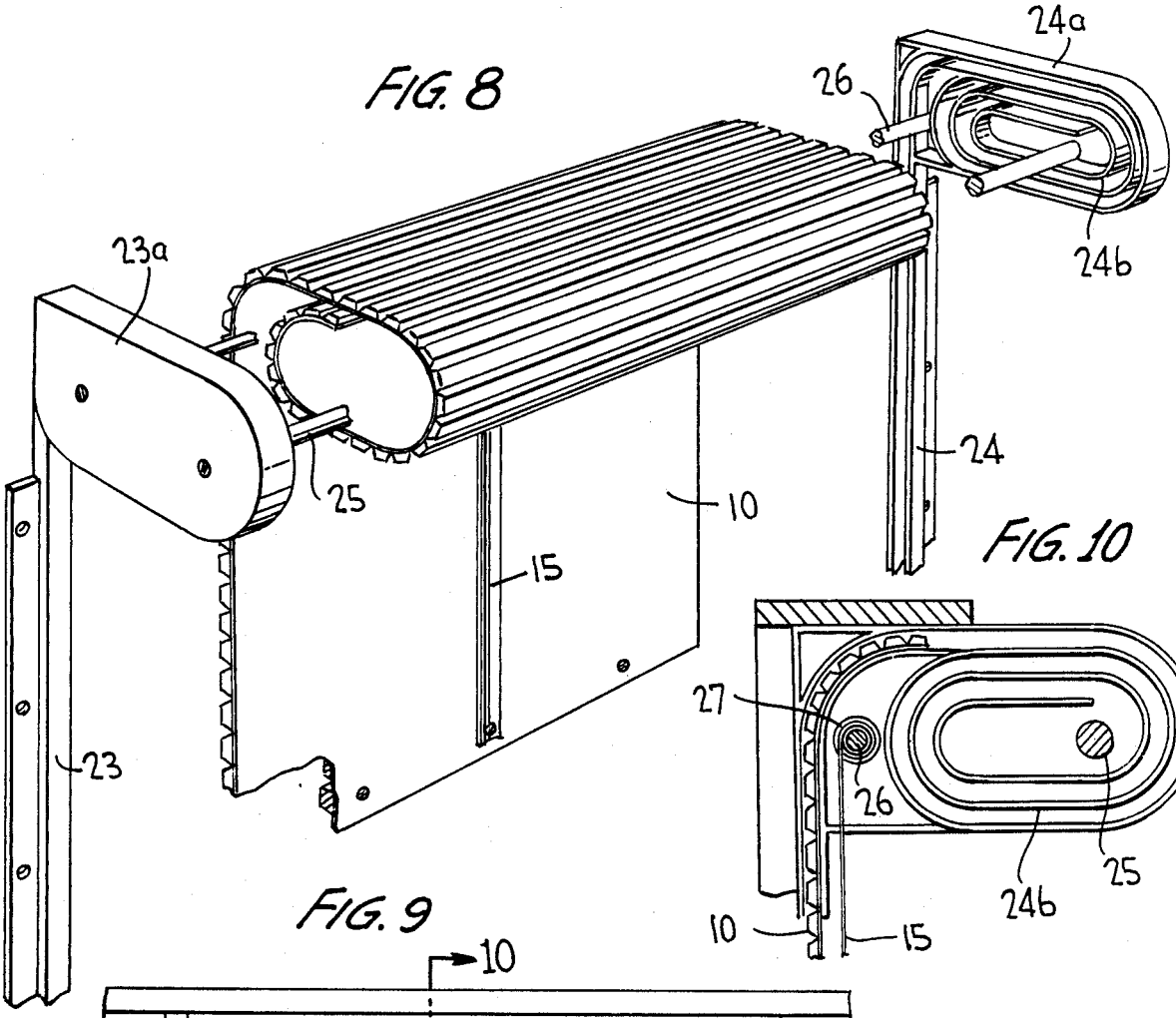
FIG. 10
FIG. 9
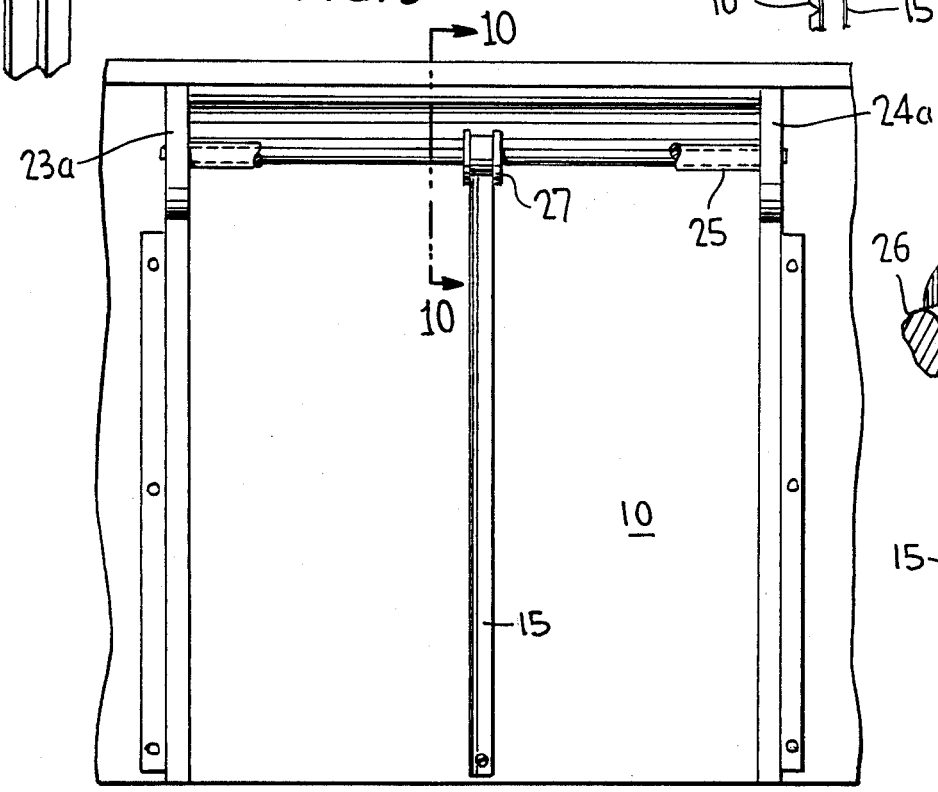
FIG. 11
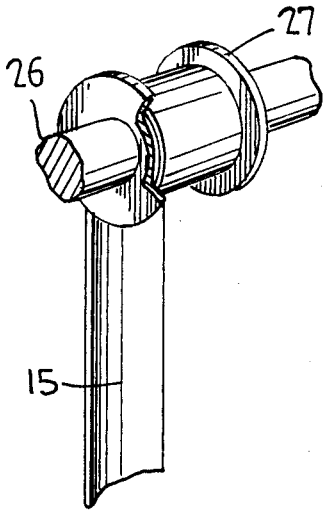

SPRING-OPERATED TAMBOUR APPARATUS

BACKGROUND OF THE INVENTION

1. Field of the Invention

This invention relates to apparatus for controlling the operation of tambour doors, and in particular to such apparatus using a spring for controlling the opening and closing of tambour doors.

2. Related Art

Appliance garages now on the market rely upon a track to guide the tambour door into a storage area above the door opening. This track is often made of plastic and is fastened to the door frame. A problem with such a design is the difficulty in making the unit slide easily in the track and still not free-fall as the tambour door is moving through the doorway.

The problem of free-falling can be eliminated in various ways, such as by a friction lock mounted in the tambour door to hold it in position, or by some other means of counter-balancing the weight of the tambour door.

Other designs counterbalance the tambour door via a spring, mounted to coil tighter as the door is closed. The principle of this design is a step forward in eliminating the free-falling door, although it also imposes a problem. The coil spring must be matched to the tambour door weight very closely, and therefore requires an adjustment in tension by the installer. The change in tambour door weight as it is closed will only match one spring rate relative to a particular door width. For a wider tambour door, a different spring rate is required. To minimize the tambour door from moving up by itself, a friction latch is employed at the end of the track to engage the door when it is fully closed.

SUMMARY OF THE INVENTION

In accordance with the present invention the weight of the door is counterbalanced by a constant tension flat spring. The mounting of the spring relative to the tambour door does not require different mounting hardware such as certain of the prior art spring counterbalancing designs as discussed above, and therefore could be retrofitted to the present tambour doors presently in use.

The flat spring recoil can be mounted to assist the door opening in several ways. In one method the spring is connected to the door handle on the inside with the other end of the spring being attached to the other end of the tambour door at the top. The flat spring applies a curling force to the tambour door that resists being curled by the straight vertical track. Because the tambour door is partially curved around the plastic track at the top, even in the closed position, the tendency for the spring is to try to curl the tambour around the track to allow the spring to return to its relaxed position. However, the weight of the tambour door is offset by the curling action of the spring. This curling action has two advantages, first it supplies a lifting action to the door, and second, it provides a controlled friction throughout the range of travel of the tambour door, to eliminate the problem of free-fall. Because of this the spring works with a wider variety of door weights and can be retrofitted to units now in use.

In a modified technique the end of the spring at the top of the tambour door is attached to a rotatable rod. A track assembly is mounted to each side of the door frame and includes a straight portion extending the length of the door opening and an upper tracked loop portion for coiling the tambour door.

In a further modified embodiment of the invention, one end of the flat spring is attached inside the tambour door but the other end curls over a spool at the top of the door opening. This method of mounting provides a better lifting action, although it requires the tambour door to follow a track that does not curl back around the spool and intersect the flat spring. Because this track is different, this method of attachment does not lend itself to easy retrofit.

A primary object of the invention is to improve the operation of opening/closing mechanisms for tambour-type doors of all sizes.

A further object of the invention is to reduce or eliminate the problems associated with the phenomena of free-fall in the opening/closing of tambour doors.

Yet a further object of the invention is to provide a smoother-operating opening/closing mechanism for tambour doors that requires less force to operate than known tambour door opening/closing mechanism.

BRIEF DESCRIPTION OF THE DRAWINGS

The above objects, advantages and features of the invention are readily apparent from the following description of a preferred embodiments of carrying out the invention when taken in conjunction with the following drawings, wherein:

FIG. 5 is an exploded perspective view of a second embodiment of the opening/closing mechanism for a tambour door;

FIG. 6 is a partial back view of the tambour door in its closed position;

FIG. 7 is a detail view showing the manner in which the constant spring is attached to the tambour door;

FIG. 8 is an exploded perspective view of a third embodiment or the opening/closing mechanism for a tambour door;

FIG. 9 is a back view of the tambour door of FIG. 8 in a closed position;

FIG. 10 is a section along lines 10—10 of FIG. 9 showing a portion of the opening/closing mechanism; and FIG. 11 is a detail view showing the mounting of the rotatable spool, rod and the constant spring of the opening/closing mechanism of the third embodiment.

DETAILED DESCRIPTION OF THE PREFERRED EMBODIMENTS

Figure 1:
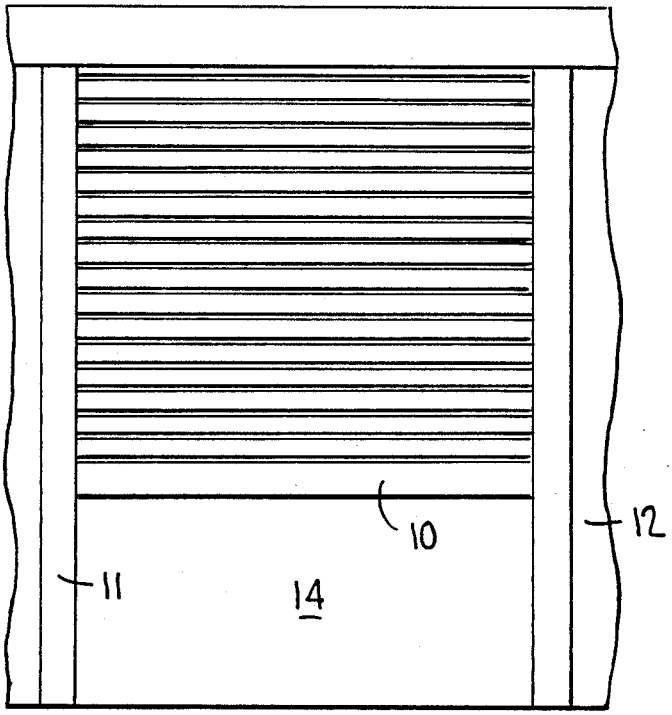
FIG. 1 is a front view of a tambour door mounted within a frame.
Figure 2:
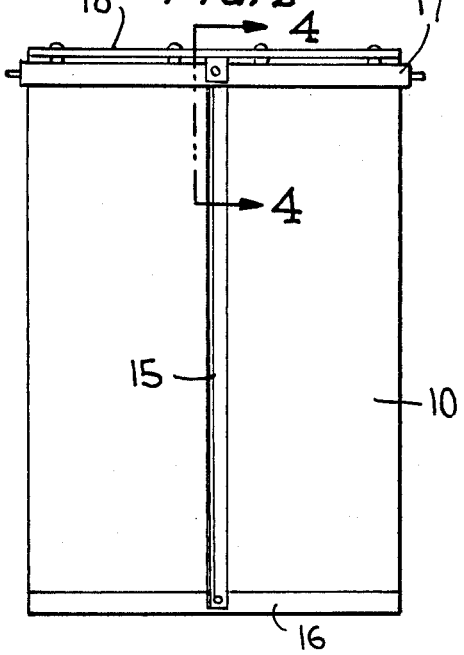
FIG. 2 is back view of the tambour door of Figure showing the manner in which it and a constant spring is mounted.
Figure 4:
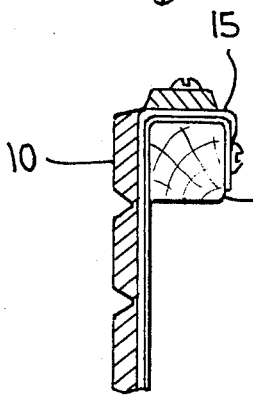
FIG. 4 is a cross section of the tambour door and a supporting rod showing the manner of attachment of the tambour door to the supporting rod.

Figure shows tambour door 10, mounted between track frame members 11 and 12 in opening 14, in a partially open state. Tambour door 10 can be manually or mechanically moved between a completely open state and a completed closed state. In the back view of the tambour door shown in FIG. 2, constant tension spring 15 is attached at the bottom 16, and to rod 17 at the top 18, of tambour door 10. The tambour door 10 is attached to rod 17 along the length thereof as shown in FIG. 2. FIG. 4 shows a detail of the attachment of the constant tension spring 15 and tambour door 10 to rod 17.

Figure 3:
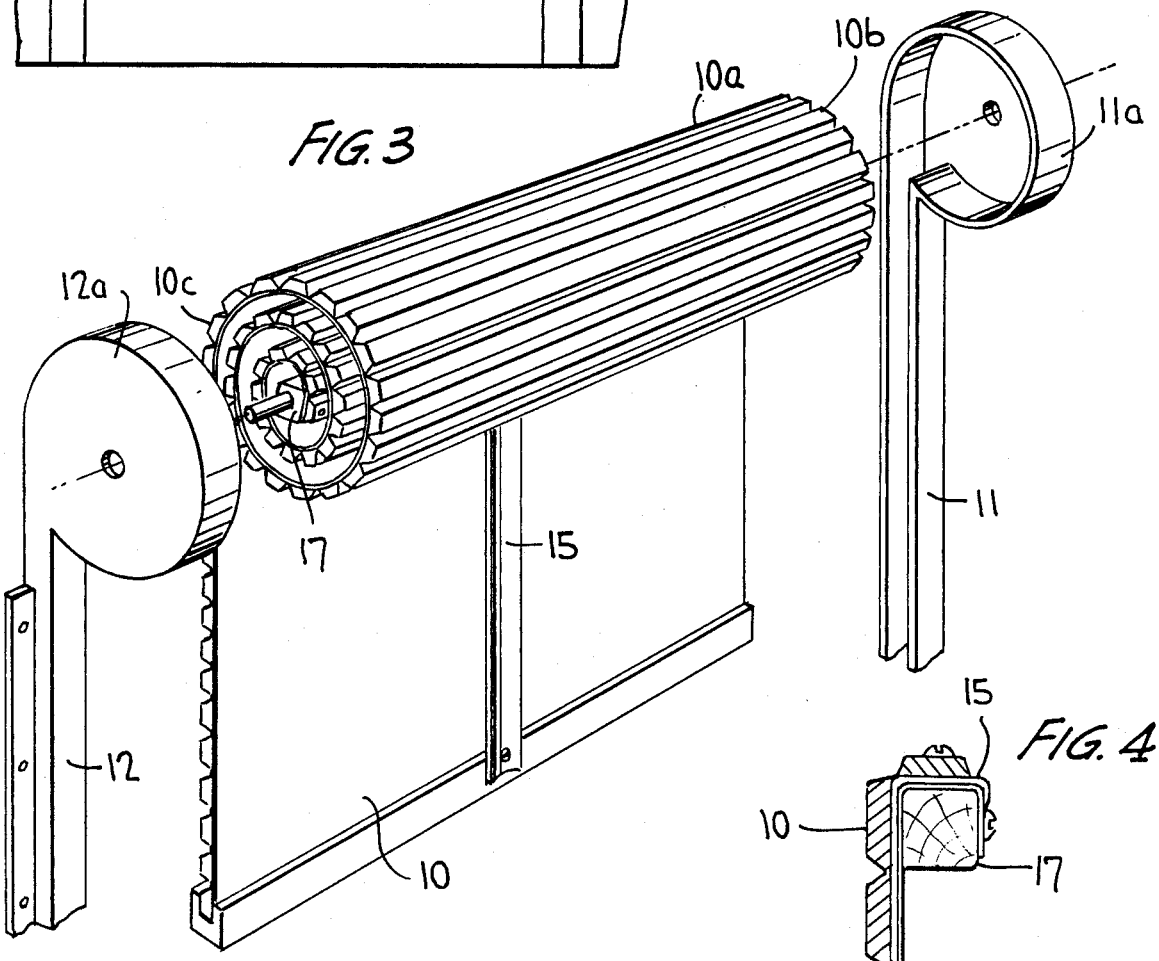
FIG. 3 is an exploded perspective view of a first embodiment the opening/closing mechanism for a tambour door.

The partially exploded perspective view of FIG. 3 shows tambour door 10 partially opened with the upper portion 10*a* of the tambour door coiled around rod 17 which is rotatably mounted to the door frame. In operation, the upper end portion 10*b* of the tambour door 10 is coiled within loop portion 11*a* of track frame 11 and upper end portion 10*c* of the tambour door is coiled within loop portion 12*a* of track frame 12. During opening or closing of tambour door 10, constant tension spring 15 applies a curling force to the tambour door 10 that resists being curled by the straight vertical track of track frame members 11 and 12. Because the upper portions 10*b* and 10*c* of the tambour door are partially curved, even in the closed position of the tambour door, the tendency is for spring 15 to try to curl the tambour door around the track to allow spring 15 to return its relaxed position. In trying to do this the weight of the tambour door 10 is offset by the curling action of the spring 15. This curling action has two advantages. First it applies a lifting action to the tambour door 10, and secondly it provides a controlled friction throughout the range of travel, thereby eliminating free-fall.

The second embodiment of the tambour door opening/closing apparatus of the invention is shown in FIG. 5. There are essentially three differences between this second embodiment and the first embodiment just described. First, the upper end of spring 15 is not attached to rod 17′ but to the upper portion of the tambour door 10. Second, loop portions 20*a* and 21*a* of track frame members 20 and 21 include tracks 21*b*. Third, rod 17′ is fixedly mounted between track frame members 20 and 21 for supporting the middle portion of tambour door 10.

FIG. 6 shows the tambour door 10 and spring 15 in the closed position in which an upper portion 10*d* of the tambour door 10 is curved within loop portions 20*a* and 21*a*. FIG. 7 is a detail view showing spring 15 mounted to tambour door 10 by a screw 22.

The structure of FIG. 5 provides a smoother operation of the opening/closing apparatus as compared with that of FIG. 3.

FIG. 8 shows a third embodiment of the opening/-closing apparatus of the invention in which the tambour door 10 is mounted between track frame members 23 and 24. Spacer rod 25 is fixedly mounted between upper track portions 23*a* and 24*a*, each of which include continuous tracks 24*b*. Fixed rod 26 is spaced from rod 25 and extends between upper track portions 23*a* and 24*a*.

As shown in FIG. 9, spool 27 is rotatably mounted on rod 26 and as shown in FIGS. 10 and 11 the upper end of spring 15 is coiled over spool 27 and the other end of the spring is attached to the bottom of tambour door 10. Thus with opening of tambour door 10, the upper portion of the door is caused to coil within upper portions 23*a* and 24*a* by continuous tracks 24*b* with spring 15 coiling freely around spool 27. Preferably spring 15 is not attached to spool 27, but is wound around spool 27 like a clock spring.

The foregoing description sets forth only exemplary embodiments of the best mode of carrying out the invention and is therefore not to be used to limit the scope of the invention. Modifications of the invention will be readily apparent to those skilled in the tambour door apparatus art, and therefore the scope of the invention is intended to be determined by the claims and the equivalents to which the components thereof are entitled.

What is claimed is:

1. A tambour door opening/closing apparatus, comprising:

a tambour door having a longitudinal axis and moving between open and closed positions along said longitudinal axis under the restraint of a frame guiding opposed sides of said door;

a constant spring mounted to said tambour door and having at least a section thereof extending generally along said longitudinal axis to assist in moving said tambour door between said opened and closed positions; and a fixed rod mounted between the frames guiding opposed sides of said door and a spool rotatably mounted on said rod and wherein said spring is coiled around said spool and the exposed end of said constant spring is attached to said tambour door.

2. The tambour door opening/closing apparatus as claimed in claim 1, further comprising a track assembly mounted on each side of said frame for guiding the movement of said tambour door and including a substantially straight track portion extending the length of said opening and a loop portion including a coiled track for forming coils of said tambour door with movement of said tambour door from said closed to said open position, and a fixed spacer rod mounted between each said track assembly for supporting said track assembly.

3. The tambour door opening/closing apparatus as claimed in claim 2, wherein said fixed rod lies adjacent said tambour door between said tambour door and said coiled track, and said fixed rod and said fixed spacer rod lie substantially in the same plane.

4. The tambour door opening/closing apparatus as set forth in claim 1, wherein said spool is positioned on said fixed rod substantially midway between the frames guiding opposed sides of said door.

5. The tambour door opening/closing apparatus as claimed in claim 4, wherein said exposed end of said constant spring is attached to said tambour door at a point in the center thereof remote from said spool with said tambour door in said closed position.

6. The tambour door opening/closing apparatus as claimed in claim 3, wherein said track assembly is continuous and oval-shaped.

* * * * *